US010527244B2

(12) United States Patent
Yan et al.

(10) Patent No.: US 10,527,244 B2
(45) Date of Patent: Jan. 7, 2020

(54) AUTOMOBILE LAMP LIGHTING DEVICE, AUTOMOBILE LAMP ASSEMBLY AND AUTOMOBILE

(71) Applicant: HASCO VISION TECHNOLOGY CO., LTD., Shanghai (CN)

(72) Inventors: Meng Yan, Shanghai (CN); Juejing Yang, Shanghai (CN)

(73) Assignee: HASCO VISION TECHNOLOGY CO., LTD., Jiading District, Shanghai (CN)

( * ) Notice: Subject to any disclaimer, the term of this patent is extended or adjusted under 35 U.S.C. 154(b) by 0 days.

(21) Appl. No.: 16/108,332

(22) Filed: Aug. 22, 2018

(65) Prior Publication Data

US 2019/0107265 A1 Apr. 11, 2019

(30) Foreign Application Priority Data

Aug. 24, 2017 (CN) ..... 2017 1 0735717
Aug. 24, 2017 (CN) ..... 2017 2 1073612 U

(51) Int. Cl.
*F21S 41/148* (2018.01)
*F21S 41/32* (2018.01)
*F21S 41/151* (2018.01)
*F21S 41/255* (2018.01)

(52) U.S. Cl.
CPC ..... *F21S 41/148* (2018.01); *F21S 41/151* (2018.01); *F21S 41/321* (2018.01); *F21S 41/323* (2018.01); *F21S 41/255* (2018.01)

(58) Field of Classification Search
CPC .. F21S 43/10; F21S 43/13; F21S 43/14; F21S 43/145; F21S 43/16; F21S 43/19; F21S 41/148; F21S 41/151; F21S 41/321; F21S 41/323; F21S 41/255; F21S 41/663; F21S 41/32; F21S 41/33; F21S 41/337; F21S 41/36; F21Y 2101/00; B60Q 2/2607; B60Q 2/2696; F21V 7/005; F21V 7/0083
See application file for complete search history.

(56) References Cited

U.S. PATENT DOCUMENTS

2011/0096551 A1* 4/2011 Sekela ..... A47F 3/001 362/296.01
2019/0107265 A1* 4/2019 Yan ..... F21S 41/663

* cited by examiner

*Primary Examiner* — Joseph L Williams
*Assistant Examiner* — Jose M Diaz
(74) *Attorney, Agent, or Firm* — Global IP Services; Tianhua Gu

(57) ABSTRACT

The present invention relates to the technical field of vehicle lamps, and in particular, to a vehicle lamp illuminating apparatus, a vehicle lamp assembly comprising the vehicle lamp illuminating apparatus, and a vehicle comprising the vehicle lamp assembly. The vehicle lamp illuminating apparatus comprises a lens, a reflection structure, a plurality of light emitting diode (LED) light sources distributed in an array and arranged in an upper row and a lower row along a transverse direction, and a circuit board connected to the plurality of LED light sources, wherein the reflection structure comprises a plurality of reflection mirror sets each disposed in one-to-one correspondence with two LED light sources that are vertically opposite to each other, the reflection mirror set comprises an upper reflection mirror corresponding to the LED light source in the upper row and a lower reflection mirror corresponding to the LED light source in the lower row.

10 Claims, 4 Drawing Sheets

AUTOMOBILE LAMP LIGHTING DEVICE, AUTOMOBILE LAMP ASSEMBLY AND AUTOMOBILE

BACKGROUND OF THE PRESENT INVENTION

Field of the Invention

The present invention relates to the technical field of vehicle lamps, and in particular, to a vehicle lamp illuminating apparatus, a vehicle lamp assembly comprising the vehicle lamp illuminating apparatus, and a vehicle comprising the vehicle lamp assembly.

Description of Related Arts

With the development of Light Emitting Diode (LED) technologies, LED has been widely applied to various fields. LED is also applied to an external illumination aspect of vehicles more commonly due to advantages such as low heat generation, long service life, environmental protection, quick response speed, being easily designed due to small volume, and the like.

A matrix LED self-adaptive headlamp can be used to adjust road illumination according to the situation of other traffic participants. For example, when the matrix LED self-adaptive headlamp is applied to high beam illumination, by intelligently adjusting a light pattern, danger caused by dazzle to a driver coming from an opposite direction is avoided. In addition, desirable illumination in other areas than the area in which the coming vehicle is located is ensured. The present invention aims to provide a vehicle lamp illuminating apparatus that can adjust luminance of a local area of an illuminating light pattern by controlling a light source, so as to meet a self-adaptive requirement of the headlamp.

SUMMARY OF THE PRESENT INVENTION

A technical problem to be resolved in the present invention is to provide a vehicle lamp illuminating apparatus, a vehicle lamp assembly comprising the vehicle lamp illuminating apparatus, and a vehicle comprising the vehicle lamp assembly that can adjust luminance of a local area of an illuminating light pattern and implement various illuminating light patterns, so as to overcome the foregoing defects in the prior art.

To resolve the foregoing technical problem, the present invention uses the following technical solutions:

A vehicle lamp illuminating apparatus comprises a lens, a reflection structure, a plurality of LED light sources distributed in an array and arranged in an upper row and a lower row along a transverse direction, and a circuit board connected to the plurality of LED light sources, where the reflection structure comprises a plurality of reflection mirror sets, each of the plurality of reflection mirror sets is in one-to-one correspondence with two LED light sources that are vertically opposite to each other, the reflection mirror set comprises an upper reflection mirror corresponding to the LED light source in the upper row and a lower reflection mirror corresponding to the LED light source in the lower row; and light emitted by the LED light source in the upper row is incident into the lens after being reflected by the upper reflection mirror, and light emitted by the LED light source in the lower row is incident into the lens after being reflected by the lower reflection mirror.

Preferably, two circuit boards are provided, the two circuit boards are spaced from each other and are vertically disposed opposite to each other, the LED light sources in the upper row and the lower row are respectively disposed on opposite surfaces of the two circuit boards, the upper reflection mirror and the lower reflection mirror are located between the two circuit boards.

Preferably, the upper reflection mirror has an upper reflection surface corresponding to the LED light sources in the upper row, the lower reflection mirror has a lower reflection surface corresponding to the LED light sources in the lower row, and the upper reflection surface and the lower reflection surface form a cone with contraction opening facing toward the lens.

Preferably, one circuit board is provided, the LED light sources in the upper row is disposed on an upper surface of the circuit board, and the LED light sources in the lower row is disposed on a lower surface of the circuit board, and the upper reflection mirror is disposed above the circuit board, and the lower reflection mirror is disposed below the circuit board in an opposite manner.

Preferably, the upper reflection mirror and the lower reflection mirror are in an encircling form and an opening direction faces the lens.

Preferably, a shielding member, configured to prevent light emitted by the LED light sources from being directly incident into the lens, is disposed between the LED light sources and the lens.

Preferably, the LED light source is disposed on the circuit board, rotates around a transverse direction, wherein a maximum angle by which the LED light source rotates around the transverse direction does not exceed 60°.

Preferably, the lens is a balsaming lens.

A vehicle lamp assembly comprises the vehicle lamp illuminating apparatus described above.

A vehicle comprises the vehicle lamp assembly described above.

Compared with the prior art, the present invention has a notable progress:

The reflection structure is disposed between an LED light source array and the lens, so that all light emitted by the LED light sources can be incident into the lens after being reflected by the reflection structure. In addition, each LED light source located in the upper row and an upper reflection mirror corresponding to the LED light source in the upper row form a reflection unit. Each LED light source located in the lower row and a lower reflection mirror corresponding to the LED light source in the lower row form a reflection unit. The LED light sources distributed in an array and the reflection mirror sets form a reflection unit array. Light emitted by a single reflection unit forms a flare after being transmitted by the lens. The flare may be used as a pixel spot of an integer illuminating light pattern formed after light emitted by the reflection unit array is transmitted by the lens, thus implementing pixelation of the illuminating light pattern. A flare formed after light emitted by each reflection unit is transmitted by the lens can be individually controlled by individually controlling turning on, turning off and luminance of each LED light source. Therefore, luminance of one or more local areas of an illuminating light pattern can be adjusted. In this way, various illuminating light patterns are implemented and a self-adaptive requirement of a headlamp is met. Especially, when a vehicle comes from an opposite direction, an LED light source of a reflection unit forming a flare in an area is turned off by determining the area corresponding to the coming vehicle in the illuminating light pattern. When necessary, luminance of an LED light source of a neighboring reflection unit may further be reduced. Therefore, the illuminating light pattern can be prevented from dazzling a driver of a coming vehicle, and desirable illumination in other areas than the area in which the coming vehicle is located is ensured, thereby ensuring driving safety.

IN THE DRAWINGS

Figure 1:
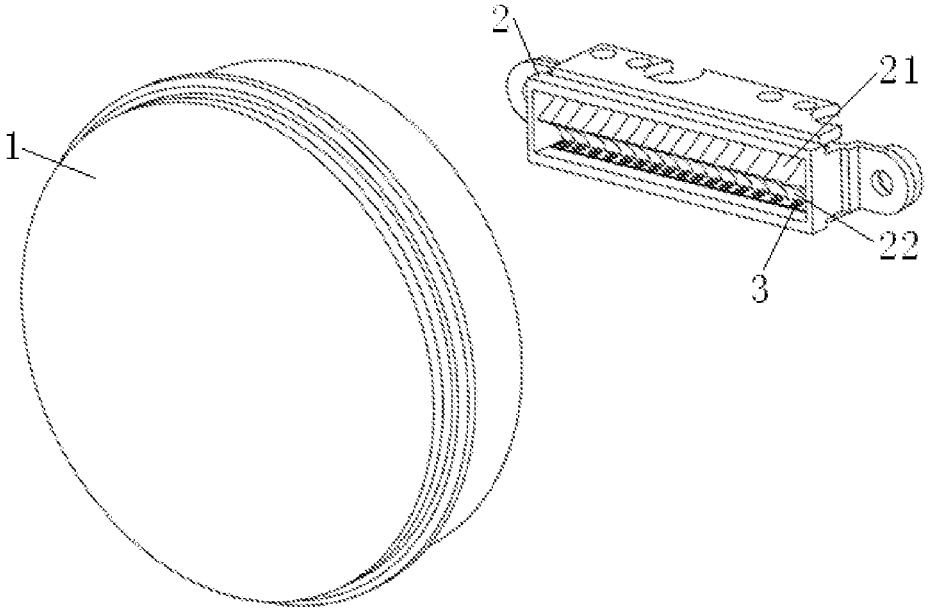
FIG. 1 is a schematic diagram of an overall structure of a vehicle lamp illuminating apparatus according to Embodiment 1 of the present invention.
Figure 2:
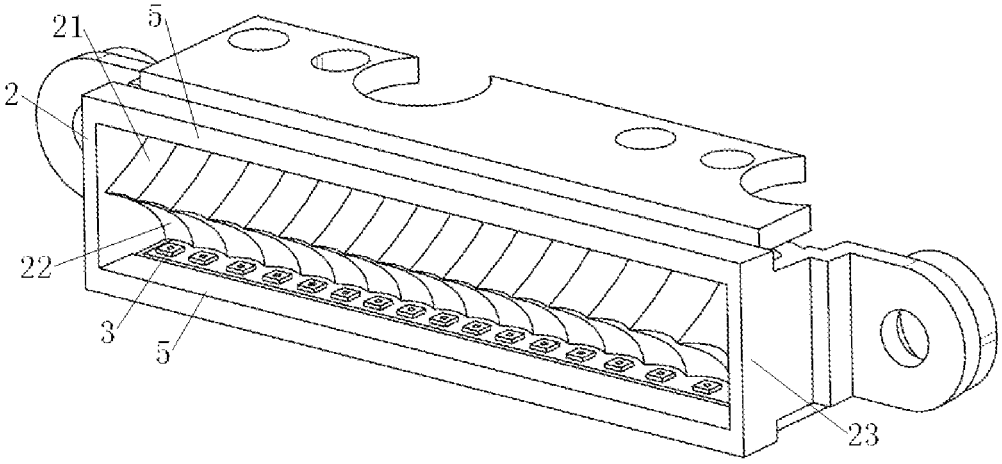
FIG. 2 is a schematic structural diagram of a vehicle lamp illuminating apparatus whose lens is removed according to Embodiment 1 of the present invention.
Figure 3:
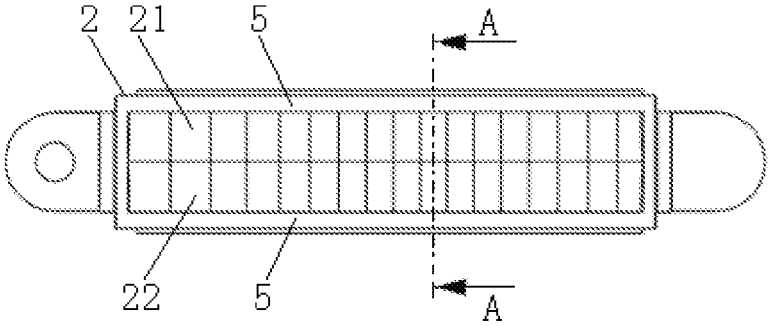
FIG. 3 is a schematic front view of a vehicle lamp illuminating apparatus whose lens is removed according to Embodiment 1 of the present invention.

1: Lens; 2: Reflection structure
21: Upper reflection mirror; 211: Upper reflection surface
22: Lower reflection mirror; 221: Lower reflection surface
23: Frame body; 3: LED light source
4: Circuit board; 5: Shielding member

DETAILED DESCRIPTION OF THE PREFERRED EMBODIMENTS

Specific embodiments consistent with the present invention are further described in detail hereinafter with reference to the accompanying drawings. These embodiments are merely used for describing the present invention, instead of limiting the present invention.

In the description consistent with the present invention, it should be noted that, an orientation or position relationship indicated by a term such as "center", "longitudinally", "transversely", "above", "below", "front", "behind", "left", "right", "vertical", "horizontal", "top", "bottom", "internal", or "external" is an orientation or position relationship shown based on the accompanying drawings, and is merely for ease of description of the present invention and for simplifying the description, not for indicating or implying that an indicated apparatus or element needs to have a particular orientation and be constructed and operated in a particular orientation. Therefore, the orientation or position relationship shall not be construed as a limitation to the present invention. In addition, terms "first" and "second" are merely used for an objective of description and cannot be understood as indicating or implying relative importance.

In the description consistent with the present invention, it should be noted that, unless otherwise specifically specified and defined, terms "installation", "linking", and "connection" should be generally understood. For example, connection may be a fixed connection, a detachable connection, or an integral connection; may be a mechanical connection, an electric connection, or by laser welding or other technologies; or may be a direct linking, an indirect linking by using an intermediate medium, or an internal communication between two elements. For those skilled in the art, specific meanings of the foregoing terms in the present invention may be understood based on a specific case.

In addition, in the description consistent with the present invention, unless otherwise described, "a plurality of" means two or more than two.

Embodiment 1

Figure 4:
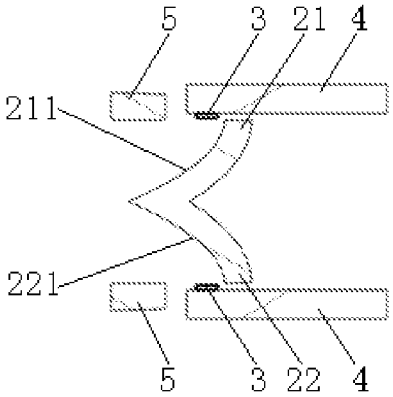
FIG. 4 is a schematic sectional view along A-A in FIG. 3.
Figure 5:
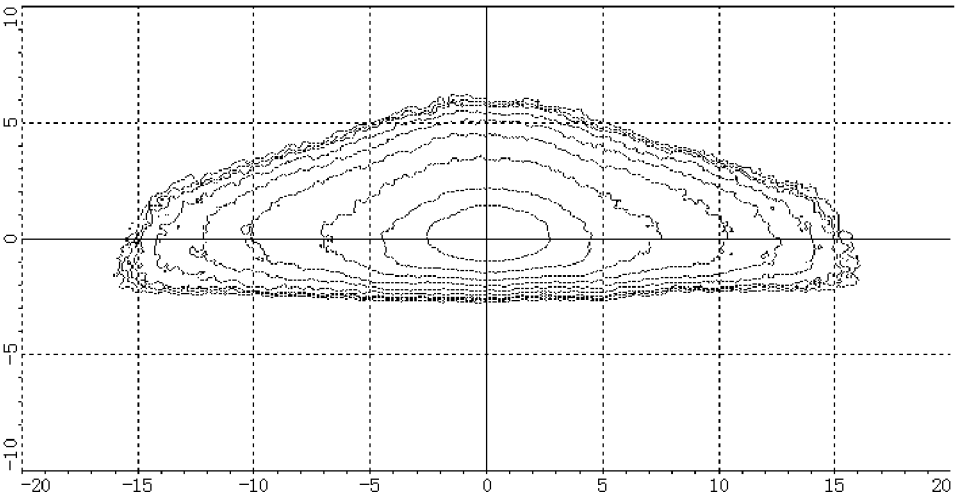
FIG. 5 is a schematic diagram of forming a complete high beam light pattern of a vehicle lamp illuminating apparatus according to Embodiment 1 of the present invention.
Figure 6:
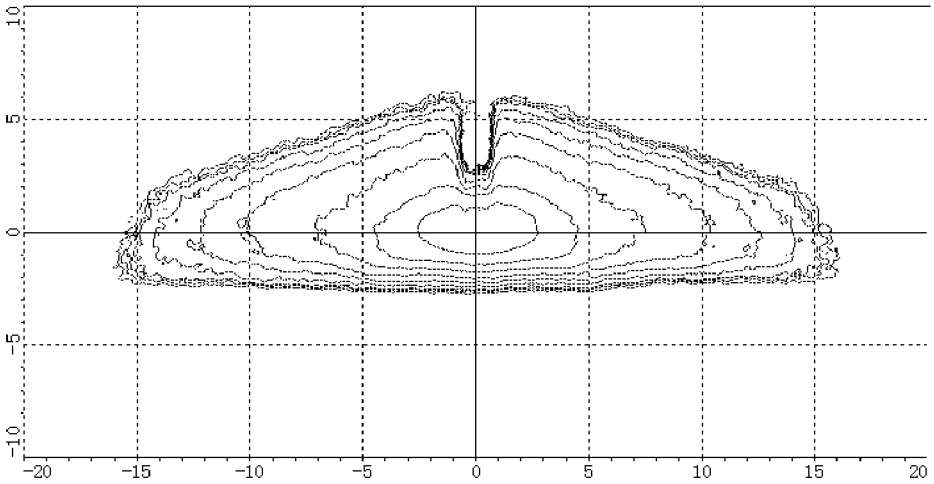
FIG. 6 is a schematic diagram of forming a high beam light pattern with a local loss formed by a vehicle lamp illuminating apparatus according to Embodiment 1 of the present invention.
Figure 7:
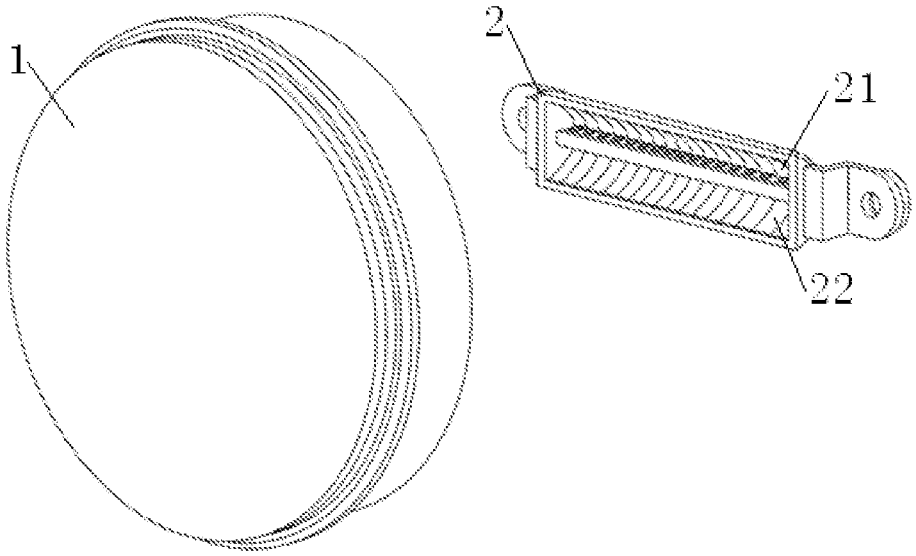
FIG. 7 is a schematic diagram of an overall structure of a vehicle lamp illuminating apparatus according to Embodiment 2 of the present invention.
Figure 8:
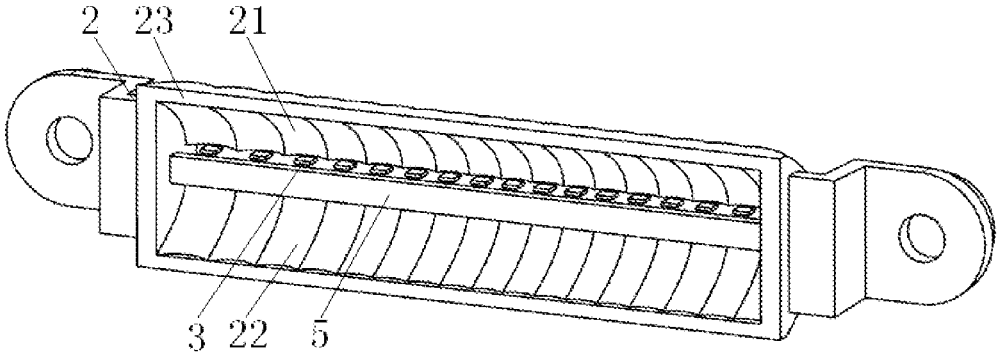
FIG. 8 is a schematic structural diagram of a vehicle lamp illuminating apparatus whose lens is removed according to Embodiment 2 of the present invention.
Figure 9:
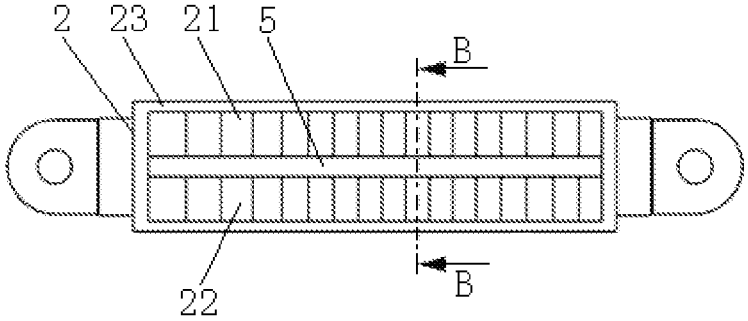
FIG. 9 is a schematic front view of a vehicle lamp illuminating apparatus whose lens is removed according to Embodiment 2 of the present invention.

FIG. 1 to FIG. 6 show an embodiment of a vehicle lamp illuminating apparatus consistent with the present invention. As shown in FIG. 1 to FIG. 4, the vehicle lamp illuminating apparatus in Embodiment 1 comprises a lens 1, a reflection structure 2, LED light sources 3, and a circuit board 4.

Wherein a plurality of LED light sources 3 are provided, and all LED light sources 3 are distributed in an array to form an LED light source array. In Embodiment 1, the LED light source array is arranged in an upper row and a lower row along a transverse direction, and is arrange in several columns along a longitudinal direction. All LED light sources 3 are connected to the circuit board 4. The circuit board 4 is configured to carry the LED light sources 3 to control on and off of each LED light source 3 individually, and can freely adjust luminance of light emitted by each LED light source 3 individually in a range from 0% to 100%. In Embodiment 1, two circuit boards 4 are provided. Referring to FIG. 4, the two circuit boards 4 are spaced from each other and are vertically disposed opposite to each other, the LED light sources 3 in the upper row and the lower row are respectively disposed on opposite surfaces of the two circuit boards 4. To be specific, the LED light sources 3 in the upper row (that is, the LED light sources 3 located in the upper row in the LED light source array) are disposed on a lower surface of the upper circuit board 4, and the LED light sources 3 in the lower row (that is, the LED light sources 3 located in the lower row in the LED light source array) are disposed on an upper surface of the lower circuit board 4. Preferably, in Embodiment 1, each LED light source 3 may be disposed on the circuit board 4, individually rotates around a transverse direction of the LED light source array, wherein a maximum angle by which each LED light source 3 rotates around the transverse direction does not exceed 60°, thus improving flexibility of adjusting an illuminating light pattern.

The reflection structure 2 comprises a plurality of reflection mirror sets. All reflection mirror sets are arranged in a linear array, and each reflection mirror set is disposed in one-to-one correspondence with two LED light sources 3 that are vertically opposite to each other. A single reflection mirror set comprises an upper reflection mirror 21 and a lower reflection mirror 22. The lower reflection mirror 22 is located below the upper reflection mirror 21. The upper reflection mirror 21 corresponds to the LED light source 3 in the upper row. A single LED light source 3 in the upper row is located at a focus corresponding to the upper reflection mirror 21, and light emitted by the LED light source 3 in the upper row is incident into the lens 1 after being reflected by the upper reflection mirror 21. The lower reflection mirror 22 corresponds to the LED light source 3 in the lower row. A single LED light source 3 in the lower row is located at a focus corresponding to the lower reflection mirror 22, and light emitted by the LED light source 3 in the lower row is incident into the lens 1 after being reflected by the lower reflection mirror 22. In the present Embodiment 1, the upper reflection mirror 21 and the lower reflection mirror 22 in the single reflection mirror set are located between two vertically-opposite LED light sources 3 located on the two circuit boards 4. To be specific, the upper reflection mirror 21 is located below the LED light source 3 in the upper row, and the lower reflection mirror 22 is located above the LED light source 3 in the lower row.

Specifically, the upper reflection mirror 21 has an upper reflection surface 211 corresponding to the LED light source 3 in the upper row, and the lower reflection mirror 22 has a lower reflection surface 221 corresponding to the LED light source 3 in the lower row. Both the upper reflection surface 211 and the lower reflection surface 221 have a high reflectivity. The light emitted by the single LED light source 3 located in the upper row is first incident into an upper reflection surface 211 of a corresponding upper reflection mirror 21, and is incident into the lens 1 after being reflected by the upper reflection surface 211; the light emitted by the single LED light source 3 located in the lower row is first incident into a lower reflection surface 221 of a corresponding lower reflection mirror 22, and is incident into the lens 1 after being reflected by the lower reflection surface 221. The light incident into the lens 1 forms an illuminating light pattern after being transmitted by the lens 1. Preferably, in Embodiment 1, the upper reflection surface 211 of the upper reflection mirror 21 and the lower reflection surface 221 of the lower reflection mirror 22 form a cone with contraction opening facing toward the lens 1.

In the vehicle lamp illuminating apparatus in Embodiment 1, each LED light source 3 located in the upper row and an upper reflection mirror 21 corresponding to the LED light source 3 located in the upper row form a reflection unit, and each LED light source 3 located in the lower row and a lower reflection mirror 22 corresponding to the LED light source 3 located in the lower row also form a reflection unit. The LED light sources 3 distributed in an array and the reflection mirror sets form a reflection unit array. Light emitted by each LED light source 3 is incident into the lens 1 after being reflected by the reflection mirror set, and forms a flare after being transmitted by the lens 1. That is, the light emitted by a single reflection unit forms a flare after being transmitted by the lens 1. The flare may be used as a pixel spot of an integer illuminating light pattern formed after light emitted by the reflection unit array is transmitted by the lens 1, thus implementing pixelation of the illuminating light pattern. A flare formed after light emitted by each reflection unit is transmitted by the lens 1 can be individually controlled by individually controlling turning on, turning off and luminance of each LED light source 3. When all the LED light sources 3 are turned on, the light emitted by the reflection unit array forms a complete illuminating light pattern after being transmitted by the lens 1 (referring to FIG. 5); and when one or more LED light sources 3 are turned off or luminance thereof is reduced, a flare formed by the reflection unit corresponding to the LED light source 3 disappears or is darkened, so that an illuminating light pattern with a local loss is formed (referring to FIG. 6). In this way, the vehicle lamp illuminating apparatus in the present embodiment can adjust luminance of one or more local areas of an illuminating light pattern, thereby implementing various illuminating light patterns and meeting a self-adaptive requirement of a headlamp. Especially, when a vehicle comes from an opposite direction, an LED light source 3 of a reflection unit forming a flare in an area is turned off by determining the area corresponding to the coming vehicle in the illuminating light pattern. When necessary, luminance of an LED light source 3 of a neighboring reflection unit may further be reduced. Therefore, the illuminating light pattern can be prevented from dazzling a driver of a coming vehicle, and desirable illumination in other areas than the area in which the coming vehicle is located is ensured, thereby ensuring driving safety.

Preferably, in Embodiment 1, to avoid stray light, a shielding member 5 is disposed between the LED light sources 3 and the lens 1. The shielding member 5 is configured to prevent light emitted by the LED light sources 3 from being directly incident into the lens 1, and all the light emitted by the LED light sources 3 is incident into the lens 1 after being first reflected by the upper reflection mirror 21. In Embodiment 1, two shielding members 5 are provided. The two shielding members 5 are respectively disposed exactly in front of a side that faces the lens 1 and that is of the LED light sources 3 in the upper row and the LED light sources 3 in the lower row, and are respectively configured to prevent light emitted by the LED light sources 3 in the upper row and the LED light sources 3 in the lower row from being directly incident into the lens 1.

In Embodiment 1, the reflection structure 2 further comprises a frame body 23. A cavity is disposed in the frame body 23, and an end of the cavity facing the lens 1 is provided with an opening. The circuit board 4, all the LED light sources 3, the upper reflection mirrors 21, and the lower reflection mirrors 22 are disposed in the cavity. Preferably, in Embodiment 1, the shielding members 5 are also disposed on the frame body 23 of the reflection structure 2 and form an integer member with the frame body 23, thereby saving designing and manufacturing costs.

Further, a shielding member (not shown in the figure) may also be disposed between two neighboring reflection units, to prevent incident light of a reflection unit from affecting a neighboring or nearby reflection unit.

Preferably, in Embodiment 1, the lens 1 may use a balsaming lens. The balsaming lens is made of two materials of different refractive indexes by using a multiple-color injection molding manufacturing process, and mainly functions for de-dispersion.

Based on the foregoing vehicle lamp illuminating apparatus, Embodiment 1 further provides a vehicle lamp assembly. The vehicle lamp assembly in Embodiment 1 comprises the foregoing vehicle lamp illuminating apparatus in Embodiment 1.

Based on the foregoing vehicle lamp assembly, Embodiment 1 further provides a vehicle. The vehicle in Embodiment 1 comprises the foregoing vehicle lamp assembly in Embodiment 1.

Embodiment 2

Figure 10:
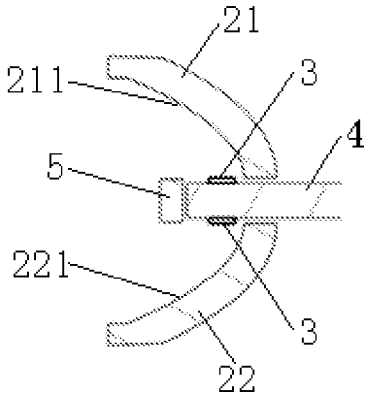
FIG. 10 is a schematic sectional view along B-B in FIG. 9.

FIG. 7 to FIG. 10 show a second embodiment of the vehicle lamp illuminating apparatus consistent with the present invention. Embodiment 2 is substantially the same as Embodiment 1, and same descriptions are not described herein again. A difference lies in that, in Embodiment 2, one circuit board 4 is provided. Referring to FIG. 10, an LED light source 3 in the upper row and an LED light source 3 in the lower row are respectively disposed on an upper surface and a lower surface of the circuit board 4. The upper reflection mirror 21 and the lower reflection mirror 22 are respectively disposed above and below the circuit board 4 in an opposite manner. To be specific, the LED light source 3 in the upper row is disposed on the upper surface of the circuit board 4, the upper reflection mirror 21 is disposed above the circuit board 4, and the upper reflection mirror 21 is located above the LED light source 3 in the upper row; the LED light source 3 in the lower row is disposed on the lower surface of the circuit board 4, the lower reflection mirror 22 is disposed below the circuit board 4, and the lower reflection mirror 22 is located below the LED light source 3 in the lower row. Preferably, in Embodiment 2, the upper reflection mirror 21 and the lower reflection mirror 22 are in an encircling form and an opening direction faces toward the lens 1.

In Embodiment 2, one shielding member 5 is adequate. The shielding member 5 is disposed exactly in front of a side that faces the lens 1 and that is of the circuit board 4, and can simultaneously prevent light emitted by the LED light source 3 in the upper row and the LED light source 3 in the lower row from being directly incident into the lens 1.

In conclusion, in the vehicle lamp illuminating apparatus, the vehicle lamp assembly comprising the vehicle lamp illuminating apparatus, and the vehicle comprising the vehicle lamp assembly consistent with the present invention, the reflection structure 2 is disposed between the LED light source array and the lens 1, so that all light emitted by the LED light sources 3 can be incident into the lens 1 after being reflected by the reflection structure 2. A flare formed after light emitted by each reflection unit is transmitted by the lens 1 can be individually controlled by individually controlling turning on, turning off and luminance of each LED light source 3. Therefore, luminance of one or more local areas of an illuminating light pattern can be adjusted. In this way, various illuminating light patterns are implemented and a self-adaptive requirement of a headlamp is met. Especially, when a vehicle comes from an opposite direction, an LED light source 3 of a reflection unit forming a flare in an area is turned off by determining the area corresponding to the coming vehicle in the illuminating light pattern. When necessary, luminance of an LED light source 3 of a neighboring reflection unit may further be reduced. Therefore, the illuminating light pattern can be prevented from dazzling a driver of a coming vehicle, and desirable illumination in other areas than the area in which the coming vehicle is located is ensured, thereby ensuring driving safety.

The foregoing descriptions are merely preferred implementations consistent with the present invention. It should be noted that those skilled in the art may make several improvements or substitutions without departing from the principle consistent with the present invention and the improvements or substitutions shall fall within the protection scope consistent with the present invention.

What is claimed is:

1. A vehicle lamp illuminating apparatus, comprising a lens (1), a reflection structure (2), a plurality of light emitting diode (LED) light sources (3) distributed in an array and arranged in an upper row and a lower row along a transverse direction, and a circuit board (4) connected to the plurality of LED light sources (3), wherein the reflection structure (2) comprises a plurality of reflection mirror sets, each of the plurality of reflection mirror sets is in one-to-one correspondence with two LED light sources (3) that are vertically opposite to each other, the reflection mirror set comprises an upper reflection mirror (21) corresponding to the LED light source (3) in the upper row and a lower reflection mirror (22) corresponding to the LED light source (3) in the lower row; and light emitted by the LED light source (3) in the upper row is incident into the lens (1) after being reflected by the upper reflection mirror (21), and light emitted by the LED light source (3) in the lower row is incident into the lens (1) after being reflected by the lower reflection mirror (22).

2. The vehicle lamp illuminating apparatus as in claim 1, wherein two circuit boards (4) are provided, the two circuit boards (4) are spaced from each other and are vertically disposed opposite to each other, the LED light sources (3) in the upper row and the lower row are respectively disposed on opposite surfaces of the two circuit boards (4), the upper reflection mirror (21) and the lower reflection mirror (22) are located between the two circuit boards (4).

3. The vehicle lamp illuminating apparatus as in claim 2, wherein the upper reflection mirror (21) has an upper reflection surface (211) corresponding to the LED light sources (3) in the upper row, the lower reflection mirror (22) has a lower reflection surface (221) corresponding to the LED light sources (3) in the lower row, and the upper reflection surface (211) and the lower reflection surface (221) form a cone with contraction opening facing toward the lens (1).

4. The vehicle lamp illuminating apparatus as in claim 1, wherein one circuit board (4) is provided, the LED light sources (3) in the upper row is disposed on an upper surface of the circuit board (4), the LED light sources (3) in the lower row is disposed on a lower surface of the circuit board (4), the upper reflection mirror (21) is disposed above the circuit board (4), and the lower reflection mirror (22) is disposed below the circuit board (4) in an opposite manner.

5. The vehicle lamp illuminating apparatus as in claim 4, wherein the upper reflection mirror (21) and the lower reflection mirror (22) are in an encircling form and an opening direction faces toward the lens (1).

6. The vehicle lamp illuminating apparatus as in claim 1, wherein a shielding member (5), configured to prevent light emitted by the LED light sources (3) from being directly incident into the lens (1), is disposed between the LED light sources (3) and the lens (1).

7. The vehicle lamp illuminating apparatus as in claim 1, wherein the LED light source (3) is disposed on the circuit board (4), rotates around a transverse direction, wherein a maximum angle by which the LED light source (3) rotates around the transverse direction does not exceed 60°.

8. The vehicle lamp illuminating apparatus as in claim 1, wherein the lens (1) is a balsaming d lens.

9. A vehicle lamp assembly, comprising the vehicle lamp illuminating apparatus as in claim 1.

10. A vehicle, comprising the vehicle lamp assembly as in claim 9.

* * * * *